US007896159B2

(12) United States Patent
Goda

(10) Patent No.: US 7,896,159 B2
(45) Date of Patent: Mar. 1, 2011

(54) PACKAGING CONTAINER AND METHOD

(75) Inventor: Hideyuki Goda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 12/385,035

(22) Filed: Mar. 30, 2009

(65) Prior Publication Data

US 2009/0242456 A1 Oct. 1, 2009

(30) Foreign Application Priority Data

Mar. 28, 2008 (JP) ..... 2008-085411

(51) Int. Cl.
*B65D 19/00* (2006.01)

(52) U.S. Cl. ..... 206/386; 206/597; 206/600; 108/55.1

(58) Field of Classification Search ..... 206/386, 206/395, 598, 600, 596, 597; 108/55.1, 55.5, 108/55.3
See application file for complete search history.

(56) References Cited

U.S. PATENT DOCUMENTS

| | | | | |
|---|---|---|---|---|
| 3,337,036 | A * | 8/1967 | Peterson | 206/598 |
| 3,568,912 | A * | 3/1971 | de Simas | 206/598 |
| 4,296,860 | A * | 10/1981 | Hsu et al. | 206/386 |
| 4,383,609 | A * | 5/1983 | Lochmiller | 206/386 |
| 4,426,015 | A * | 1/1984 | Preston et al. | 229/117.28 |
| 7,128,209 | B2 * | 10/2006 | Bringard et al. | 206/386 |
| 2005/0173280 | A1 * | 8/2005 | Cornelius et al. | 206/386 |

FOREIGN PATENT DOCUMENTS

| | | | |
|---|---|---|---|
| JP | S52-27434 | | 8/1975 |
| JP | S56-9662 | | 3/1981 |
| JP | 57-42873 | | 9/1982 |
| JP | S58-26899 | | 6/1983 |
| JP | S61-3768 | | 2/1986 |
| JP | S63-67246 | | 3/1988 |
| JP | 05065160 | A * | 3/1993 |
| JP | 05278757 | A * | 10/1993 |
| JP | 11-334736 | | 12/1999 |
| JP | 2003-226369 | | 8/2003 |

* cited by examiner

*Primary Examiner*—David T Fidei
(74) *Attorney, Agent, or Firm*—Harness, Dickey & Pierce, P.L.C.

(57) ABSTRACT

A packaging container includes a pallet, an enclosure box, an enclosure base, a sheet, and a set of fasteners. The pallet carries the article thereon. The enclosure box rests on the pallet to enclose the article therewithin, and includes a top wall, first and second pairs of opposite side walls, an open bottom, and a first set of through-holes. The enclosure base lies between the article and the pallet to hold the article. The sheet extends across at least a portion of the pallet and the first pair of opposite side walls to secure the pallet to the enclosure box when fastened to the enclosure box, and includes a flat center panel, a pair of side flaps, and a second set of through-holes. The set of fasteners are passed through the first and second sets of through-holes to fasten the sheet to the enclosure box from outside the enclosure box.

15 Claims, 10 Drawing Sheets

PACKAGING CONTAINER AND METHOD

CROSS-REFERENCE TO RELATED APPLICATIONS

The present patent application claims priority pursuant to 35 U.S.C. §119 from Japanese Patent Application No. 2008-085411, filed on Mar. 28, 2008, the contents of which are hereby incorporated by reference herein in their entirety.

BACKGROUND OF THE INVENTION

1. Field of the Invention

The present invention relates to a packaging container and method, and more particularly, to a packaging container using a pallet and enclosure box to package an article for storage and transport, and a method for packaging an article in such a container.

2. Discussion of the Background

Shipping containers are used to package large electronic equipment such as printers and copiers for storage and transport. A typical design of such containers includes an upper enclosure box to enclose an article therewithin, and a lower platform or pallet having an open-sided hollow structure to accommodate tines of a forklift during handling of the container. The enclosure box is made of corrugated cardboard with the pallet formed of wood or plywood for strength and durability, while cardboard pallets are often used depending on specific applications.

In most such containers, the pallet and enclosure box are secured to each other to form an integrated structure which prevents shifting of packaged articles during handling of the shipping container. To provide safe and efficient packaging of articles, various methods have been proposed to reliably secure an enclosure box to a pallet in an integrated pallet container.

For example, one conventional packaging container secures an enclosure box onto a pallet by passing a pair of straps around the enclosure box through side openings in the hollow pallet, and tightening the straps with a buckle or fastener connecting opposite ends of each encircling strap.

Another conventional packaging container includes a corrugated cardboard pallet having through-holes in its sides in addition to side openings to accommodate forklift tines, and an enclosure box having corresponding through-holes on sides near the bottom edge. In this packaging container, the enclosure box is secured to the pallet by engaging attachments in the corresponding through-holes of the pallet and the enclosure box.

One drawback of the securing technique using fastening straps is that the need for strapping the enclosure box and pallet makes it troublesome to assemble the container, and that handling the assembled container can damage the enclosure box where concentrated stresses are applied to those corners that are in contact with the encircling straps.

On the other hand, the packaging container having the pallet and enclosure box secured by corresponding through-holes is relatively easy to assemble, but requires the use of cardboard pallets rather than standard wood or plywood pallets, limiting practical application of this method to pallet containers integrally made of corrugated cardboard.

SUMMARY OF THE INVENTION

Exemplary aspects of the present invention are put forward in view of the above-described circumstances, and provide a novel packaging container using a pallet and enclosure box to package an article for storage and transport.

Other exemplary aspects of the present invention provide a novel method for packaging an article in a container using a pallet and enclosure box for storage and transport.

In one exemplary embodiment, the novel packaging container includes a pallet, an enclosure box, an enclosure base, a sheet, and a set of fasteners. The pallet is substantially rectangular in plan, and carries the article thereon. The enclosure box rests on the pallet to enclose the article therewithin, and includes a top wall, first and second pairs of opposite side walls, an open bottom, and a first set of through-holes. The top wall covers a top of the article. The first and second pairs of opposite side walls extend downward from the top wall to cover sides of the article. The open bottom is defined by edges of the side walls in contact with the pallet to pass the article therethrough during assembly. The first set of through-holes are defined in the first pair of side walls adjacent to the open bottom. The enclosure base lies between the article and the pallet to hold the article within the enclosure box. The sheet extends across at least a portion of the pallet and the first pair of opposite side walls to secure the pallet to the enclosure box when fastened to the enclosure box, and includes a flat center panel, a pair of side flaps, and a second set of through-holes. The flat center panel underlies the portion of the pallet. The pair of side flaps extends from opposite sides of the center panel upward along the first pair of opposite side walls beyond the first set of through-holes. The second set of through-holes is defined in the pair of side flaps to align with the first set of through-holes. The set of fasteners is passed through the first and second sets of through-holes to fasten the sheet to the enclosure box from outside the enclosure box.

In one exemplary embodiment, the packaging method includes the steps of pallet provision, base provision, article placement, box placement, sheet placement, and sheet fastening. The pallet provision step provides a pallet substantially rectangular in plan. The base provision step provides an enclosure base on the pallet. The article placement places an article on the enclosure base. The box placement places an enclosure box on the pallet to enclose the article and the enclosure base therewithin. The enclosure box includes a top wall, first and second pairs of opposite side walls, an open bottom, and a first set of through-holes. The top wall covers a top of the article. The first and second pairs of opposite side walls extend downward from the top wall to cover sides of the article. The open bottom is defined by edges of the side walls in contact with the pallet to pass the article therethrough. The first set of through-holes are defined in the first pair of side walls adjacent to the open bottom. The sheet placement places a sheet across at least a portion of the pallet and the first pair of opposite side walls. The sheet includes a flat center panel, a pair of side flaps, and a second set of through-holes. The flat center panel underlies the portion of the pallet. The pair of side flaps extends from opposite sides of the center panel upward along the first pair of opposite side walls beyond the first set of through-holes. The second set of through-holes is defined in the pair of side flaps to align with the first set of through-holes. The sheet fastening step fastens the sheet to the enclosure box from outside the enclosure box to secure the pallet to the enclosure box by passing a set of fasteners through the first and second sets of through-holes.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
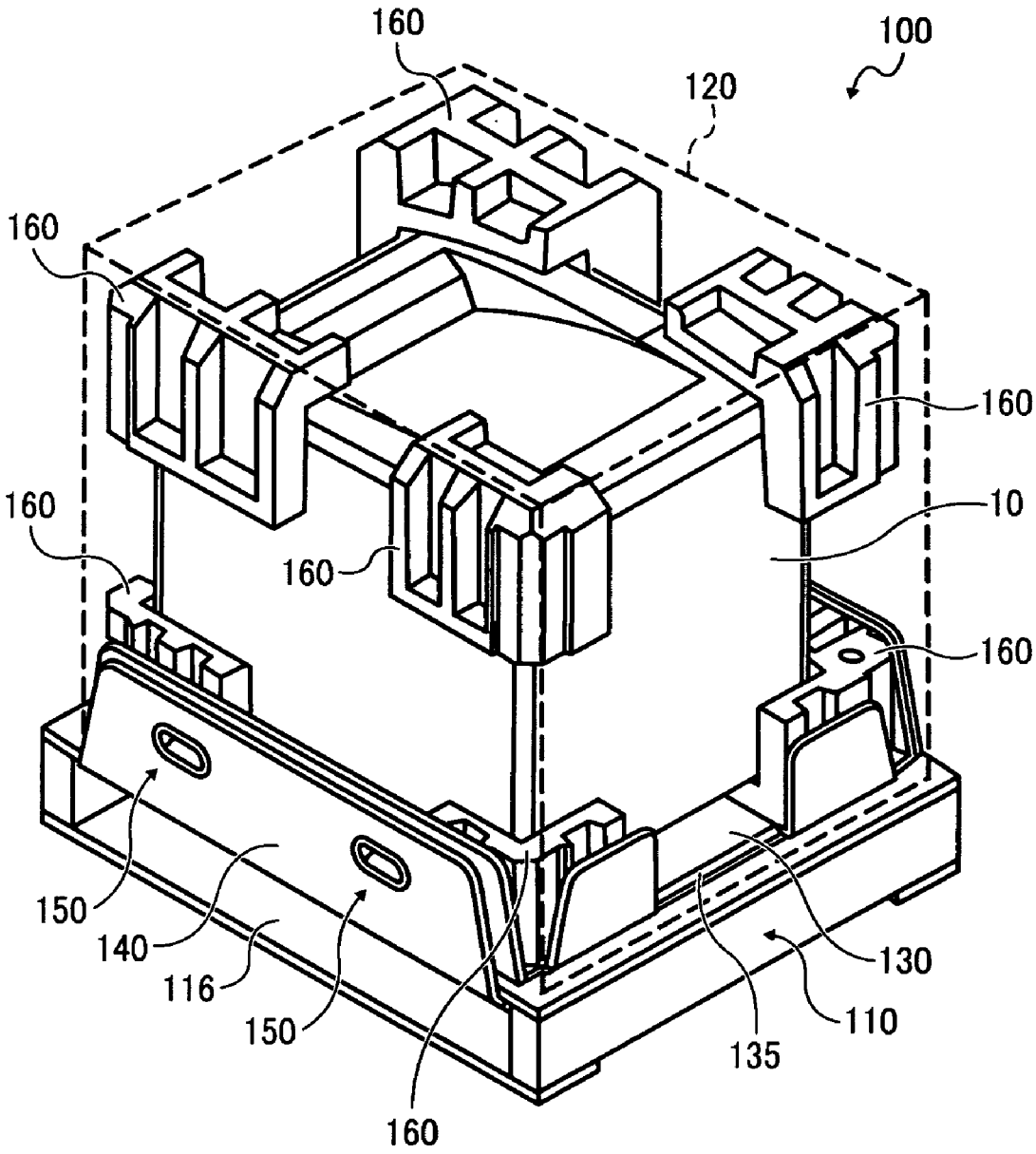
FIG. 1 is an assembled view schematically illustrating a packaging container according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 2:
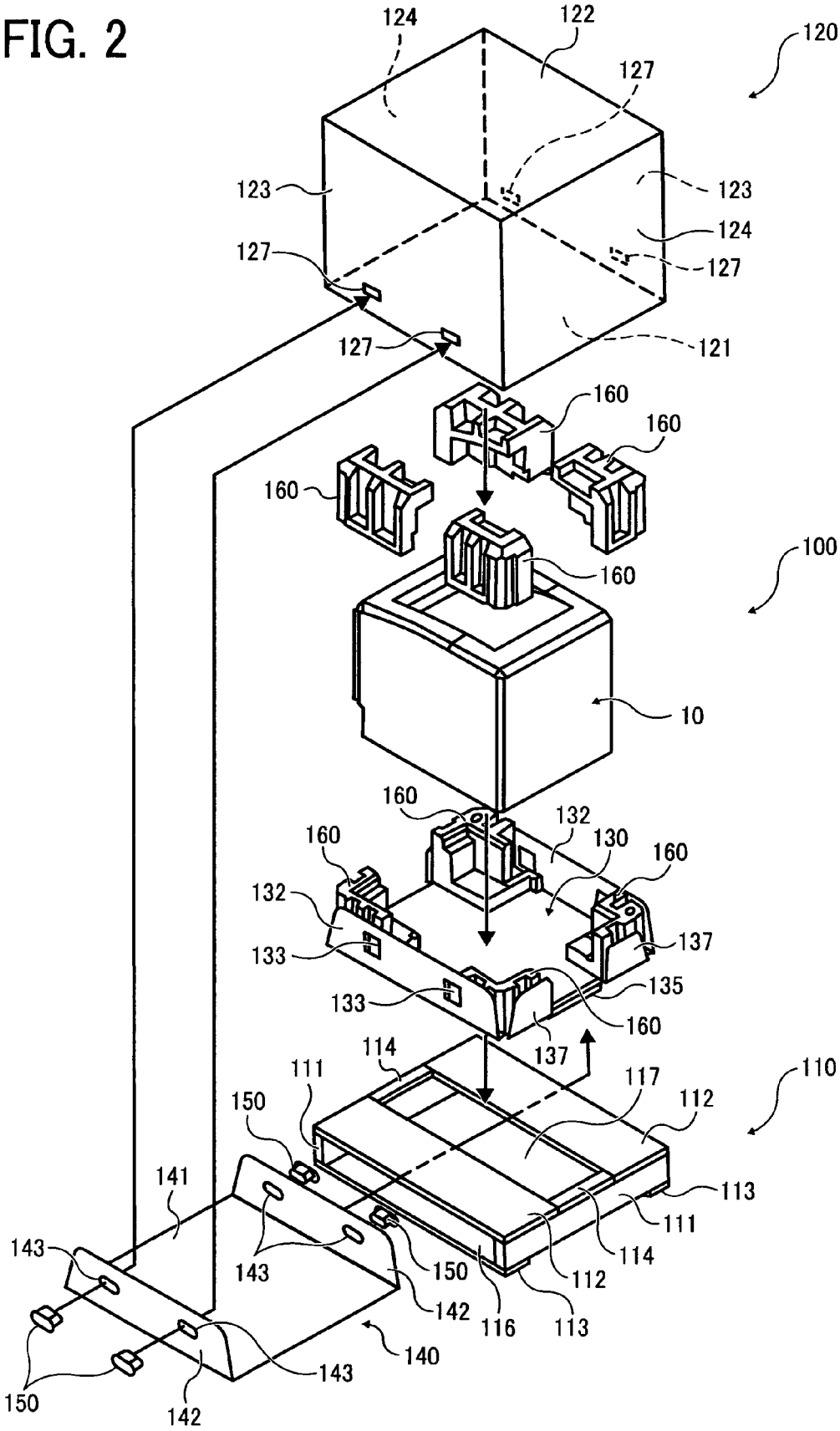
FIG. 2 is an exploded perspective views schematically illustrating the packaging container of FIG. 1.

FIGS. 1 and 2 are assembled and exploded perspective views, respectively, schematically illustrating a packaging container 100 according to one embodiment of this patent specification.

As shown in FIGS. 1 and 2, the container 100 includes a pallet 110, an open-ended enclosure box 120, an enclosure base 130, a sheet 140, a set of fasteners 150, and eight corner pads 160, all of which are assembled into an integrated structure for packaging an article 10, for example, a printer, for storage or transport.

In the container 100, the pallet 110 is substantially rectangular in plan and lies at the bottom to place the article 10 thereon. The enclosure box 120 rests on the pallet 110 to enclose the article 10 placed on the pallet 110, and the enclosure base 130 lies between the article 10 and the pallet 110 to hold the article 10 within the enclosure box 120. The sheet 140 extends across a width of the pallet 110 while fastened to the enclosure box 120 with the fasteners 150, thereby securing the pallet 110 to the enclosure box 120.

Figure 3A:
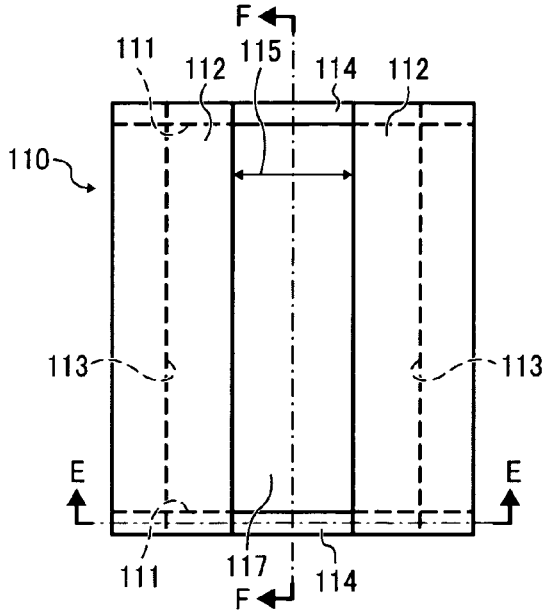
FIGS. 3A through 3D are top, front, side, and bottom views, respectively.
Figure 3C:
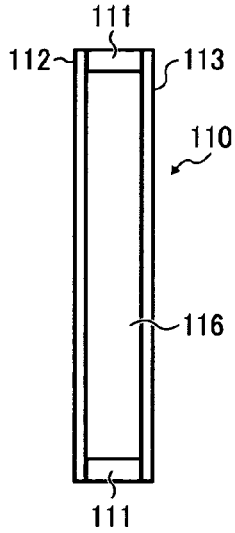
Figure 3F:
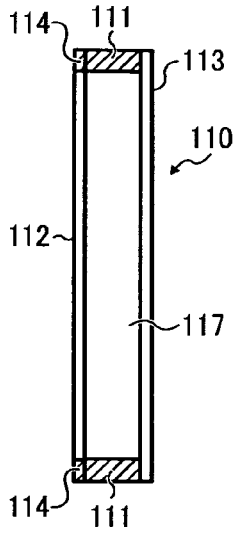
FIGS. 3E and 3F are cross-sectional views taken along line E-E and line F-F, respectively, of FIG. 3A, schematically illustrating a pallet included in the packaging container of FIG. 1.
Figure 3B:
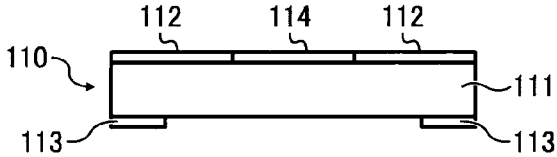
Figure 3E:
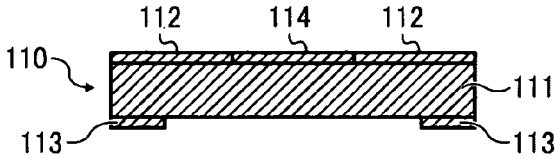
Figure 3D:
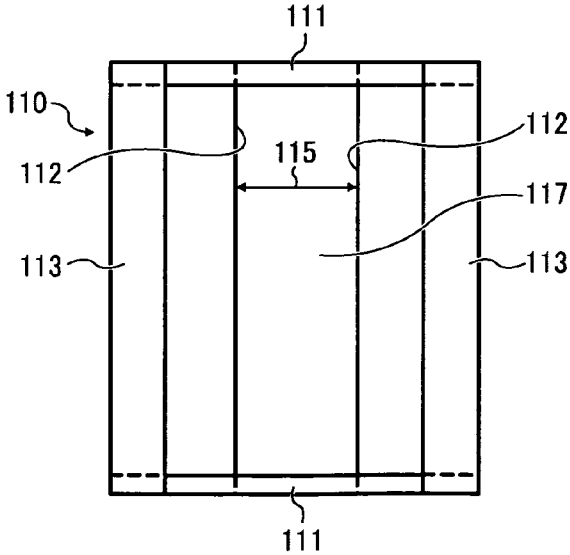

FIGS. 3A through 3D are top, front, side, and bottom views, respectively, and FIGS. 3E and 3F are cross-sectional views taken along line E-E and line F-F, respectively, of FIG. 3A, schematically illustrating the pallet 110 included in the packaging container 100 of FIGS. 1 and 2.

As shown in FIGS. 3A through 3F, the pallet 110 includes a pair of parallel stringers 111, a pair of parallel top deckboards 112 overlying the stringers 111 with a gap 115 therebetween, a pair of parallel bottom deckboards 113 underlying the stringers 111 with a gap therebetween, all of which are made of wood or plywood. The stringers 111 extend in a transverse-direction on opposite ends of the pallet 110, while the top and bottom deckboards 112 and 113 extend in a longitudinal direction perpendicular to the transverse direction to define an upper load-carrying surface and a lower load-bearing surface, respectively, of the pallet 110. The pallet 110 thus forms an open-sided hollow structure with side openings 116 leading to an interior space 117 defined by the stringers 111 and the top and bottom deckboards 112 and 113.

With particular reference to FIGS. 3A, 3B, 3E, and 3F, the pallet 110 also includes a pair of spacers 114 located on opposite ends between the top deckboards 112 above the stringers 111. Each spacer 114 is formed of wood or plywood, and has a width substantially equal to that of the adjoining stringer 111, a length substantially equal to that of the top deck gap 115, and a thickness substantially equal to that of the top deckboards 112.

In the assembled container 100, the pallet 110 supports the enclosed article 10 on the upper load-carrying surface, while allowing entry of forklift tines or forks into the space 117 through the side opening 116 during handling and transport by a forklift. Further, the pallet 110 can prevent dust and other contaminants from entering the enclosure box 120 with the top deck spacers 114 fitted into a space between the pallet 110 and the enclosure box 120.

As will be described later, the pallet 110 may interlock with the enclosure base 130 by accommodating a portion of the enclosure base 130 in the top deck gap 115, so as to restrict movement of the enclosure base 130 on the underlying pallet 110. In such a configuration, forming the deck spacer 114 and the stringer 111 of a substantially equal thickness is desirable, since it prevents the spacer 114 from projecting inward beyond the edge of the stringer 111 and urging the interlocking portion of the enclosure base 130 to interfere with proper entrance of forklift tines.

Referring back to FIG. 2, the enclosure box 120 includes an open bottom 121 and a top wall 122 opposed to each other, two pairs of opposite side walls 123 and 124 extending vertically downward from the top wall 122 to define the open bottom 121 at bottom edges thereof, and four through-holes 127, two on each side wall 123 adjacent to the open bottom 121. The enclosure box 120 is formed of corrugated cardboard, and is sized to fit on the rectangular pallet 110 when installed to enclose the article 10 of certain dimensions.

During assembly, the enclosure box 120 is placed from above onto the pallet 110 carrying the article 10 covered and cushioned by the enclosure base 130 and the corner pads 160. Thus, the article 10 together with the base 130 and the pads 160 pass through the open bottom 121 to be enclosed by the top and side walls 122, 123, and 124 in the enclosure box 120.

In the assembled container 100, the enclosure box 120 has the open bottom 121 contacting the top deckboards 112 and the top deck spacers 114, the top and side walls 122, 123, and 124 surrounding the article 10, and the through-holes 127 positioned immediately above the pallet openings 116.

Figure 4:
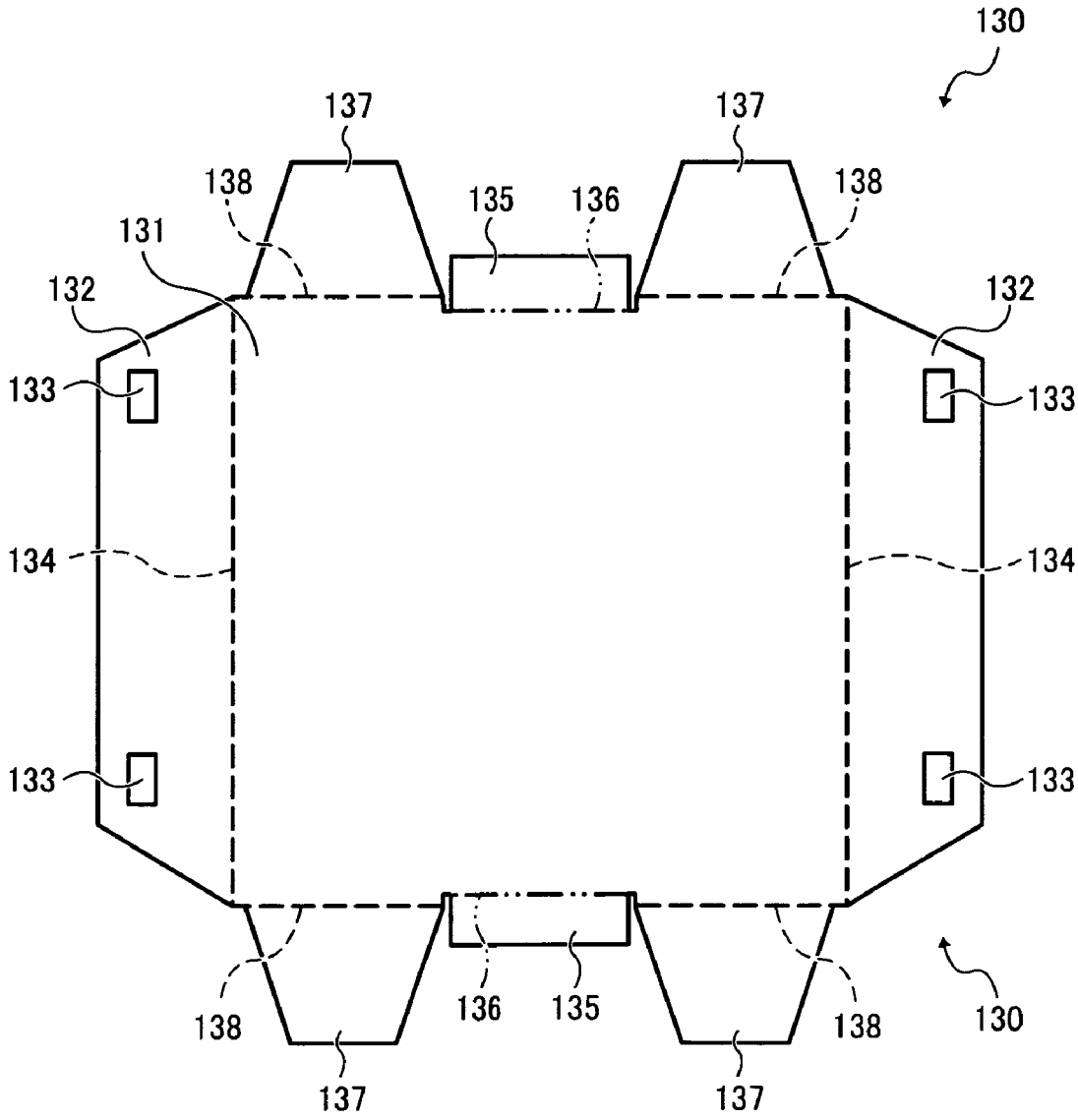
FIG. 4 is a plan view schematically illustrating an example of an enclosure base included in the packaging container of FIG. 1.
Figure 5:
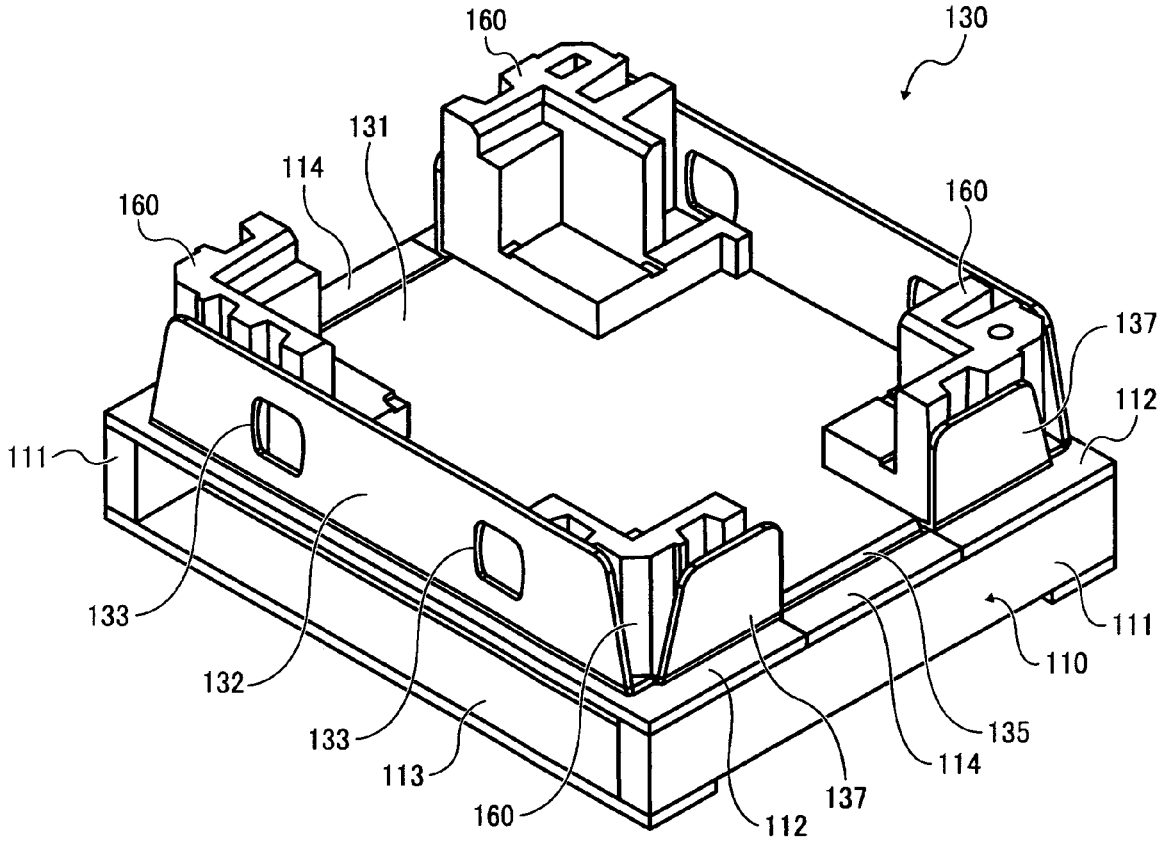
FIG. 5 is a perspective view schematically illustrating the enclosure base of FIG. 4.

FIGS. 4 and 5 are plan and perspective views, respectively, schematically illustrating an example of the enclosure base 130 before and during assembly, included in the packaging container 100.

As shown in FIG. 4, the enclosure base 130 before assembly includes a substantially rectangular center panel 131; a pair of side flaps 132 extending outward from a pair of opposed parallel sides of the center panel 131; four openings 133, two on each side flap 132; a pair of tabs 135 extending outward from another pair of opposed parallel sides of the center panel 131; and two pairs of narrow end flaps 137 extending outward from the center panel 131 on sides of the tabs 135. Also included are a pair of parallel fold lines 134 separating the center panel 131 from the side flaps 132, a pair of parallel, middle fold lines 136 separating the center panel 131 from the tabs 135, and two pairs of parallel fold lines 138 separating the center panel 131 from the end flaps 137. Such components of the enclosure base 130 are integrally formed of a single flat blank of corrugated cardboard, and are properly sized to support the article 10 inside the open bottom 121 of the enclosure box 120 when folded and assembled into the integrated container 100.

During assembly, the flat blank of the base 130 is folded upward along the fold lines 134 and 138 to raise the side flaps 132 and the end flaps 137 above the center panel 131, and downward along the fold lines 136 to lower the end tabs 135 below the center panel 131. The base 130 after folding is placed on the top deck of the pallet 110, followed by placing the corner pads 160 at four corners of the center panel 131.

As shown in FIG. 5, the enclosure base 130 thus installed has the center panel 131 overlying the top deckboards 112 with the tabs 135 inserted into the top deck gap 115 against the top deck spacers 114, and the side and end flaps 132 and 137 raised along the sides and ends of the pallet 110 to support the corner pads 160 in place on the center panel 131.

As mentioned, the tabs 135 accommodated in the top deck gap 115 forms an interlock to restrict movement of the enclosure base 130 on the underlying pallet 110. The end tabs 135 are sized to project downward below the top deckboards 112 only a distance sufficient to stabilize the enclosure base 130, since too large a projection into the space 117 would interfere with proper insertion of the forklift tines.

With additional reference to FIGS. 1 and 2, in the assembled container 100, the enclosure base 130 lies between the pallet 110 and the article 10 within the enclosure box 120. With the side and end flaps 132 and 137 properly aligning the lower corner pads 160 on the center panel 131, the enclosure base 130 can hold the article 10 in place within the enclosure box 120. In addition, the side flaps 132 have the flap openings 133 facing the through-holes 127 of the enclosure box 120. These openings 133 are larger in size than the through-holes 127, and serve to prevent the fasteners 150 from interfering with the side flaps 132 during installation.

Figure 6:
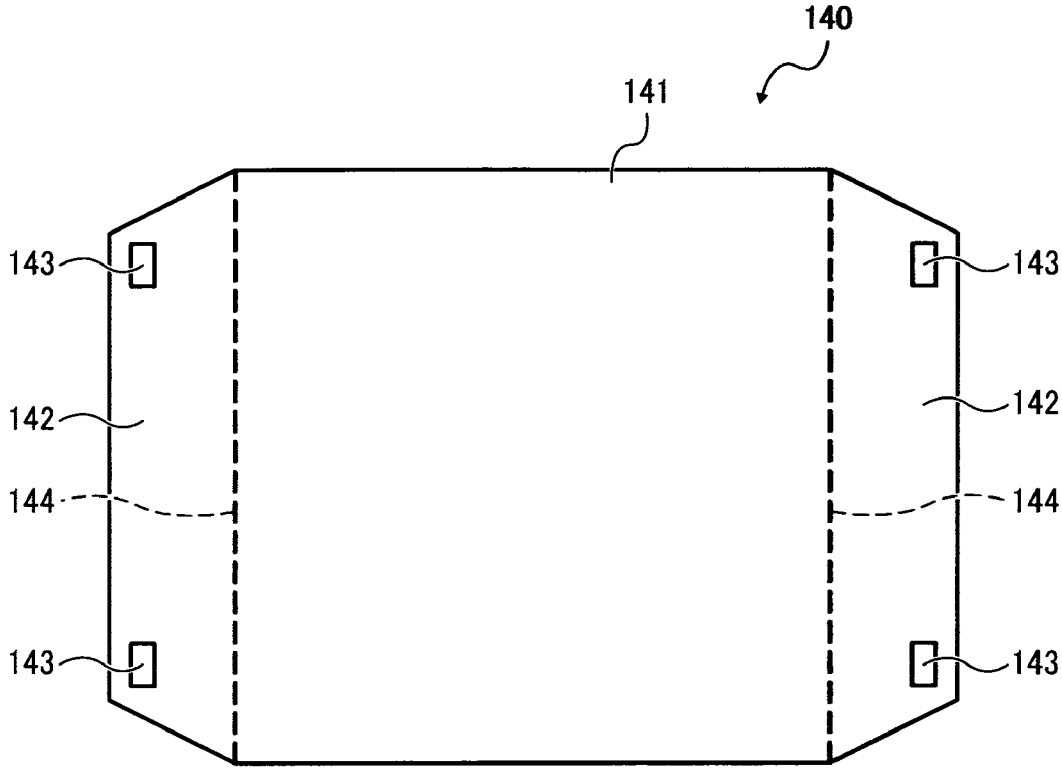
FIG. 6 is a plan view schematically illustrating an example of a sheet included in the packaging container of FIG. 1.

FIG. 6 is a plan view schematically illustrating an example of the sheet 140 before assembly, included in the packaging container 100.

As shown in FIG. 6, the sheet 140 includes a substantially rectangular center panel 141, a pair of side flaps 142 extending outward from opposed parallel sides of the center panel 141, four through-holes 143, two on each side flap 142, and a pair of parallel fold lines 144 separating the center panel 141 from the side flaps 142. Such components of the sheet 140 are integrally formed of a single flat blank of corrugated cardboard.

During assembly, the blank of the sheet 140 is inserted through the side opening 116 into the space 117 of the pallet 110 carrying the article 10 enclosed in the enclosure box 120. After insertion, the sheet 140 is folded upward along the fold lines 144, so as to raise the side flaps 142 beyond the through-holes 127 of the enclosure box 120 with the through-holes 143 aligned with the through-holes 127 of the enclosure wall 123 for fastening with the fasteners 150.

As shown in FIGS. 1 and 2, in the assembled container 100, the sheet 140 extends across the width of the pallet 110 and the enclosure box 120. With the side flaps 142 fastened to the enclosure walls 123, the sheet 140 secures the pallet 110 to the enclosure box 120. Further, the sheet 140 covers the top deck gap 115 of the pallet 110 with the center panel 140 from below for secure and safe handling with forklift tines.

Figure 7:
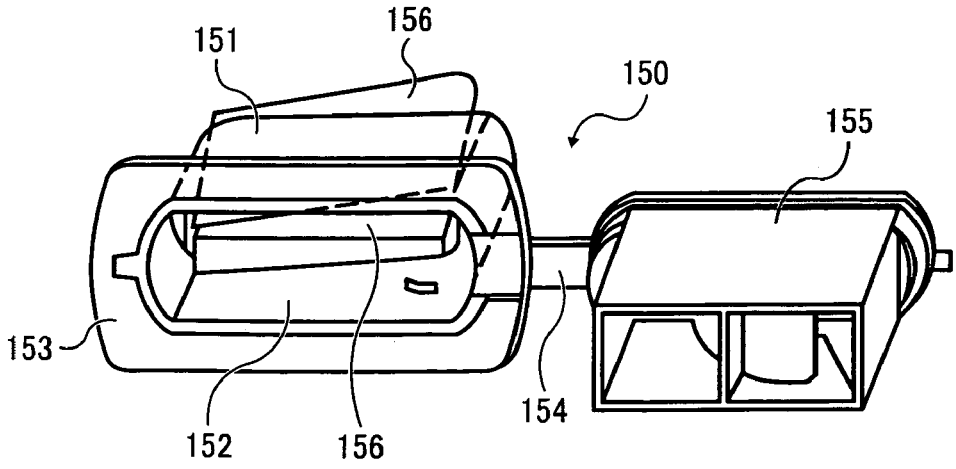
FIG. 7 schematically illustrates an example of a fastener for use in the packaging container of FIG. 1.

FIG. 7 schematically illustrates an example of the fastener 150 for use in the packaging container 100.

As shown in FIG. 7, the fastener 150 is constituted of an open-ended tubular body 151 having one open end surrounded by a flange 153, and the other open end having a pair of angled plates 156, each forming an "L" in cross-section and hinged to an inner wall of the tubular body 151, and a plug 155 connected to the flange 153 via a hinge 154, all of which are formed as a single integrated unit made of synthetic resin. Before use, the fastener 150 has the plug 155 outside the tubular body 151 so that the hinged plates 156 point their free ends in the same direction. This allows the flange-less end of the tubular body 150 to enter an opening of a particular size. Inserting the plug 155 into the tubular body 151 causes the plates 156 to turn on their respective hinges, enabling the fastener 150 to hold together walls of a certain thickness between the flange 153 and the plates 156.

Figure 8A:
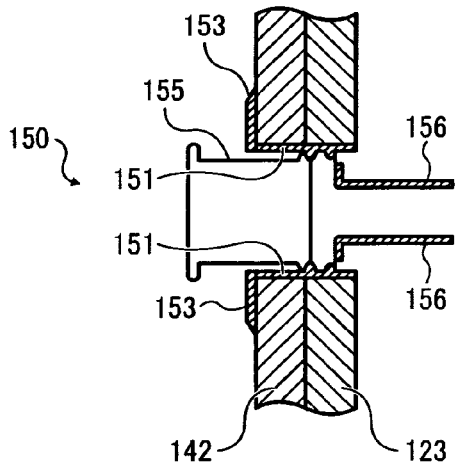
FIGS. 8A through 8C are cross-sectional views schematically illustrating the fastener of FIG. 7 in use.
Figure 8B:
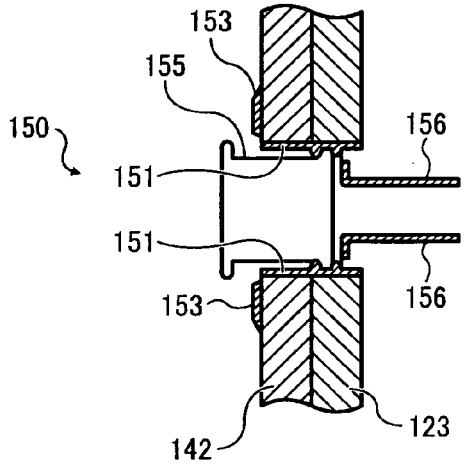
Figure 8C:
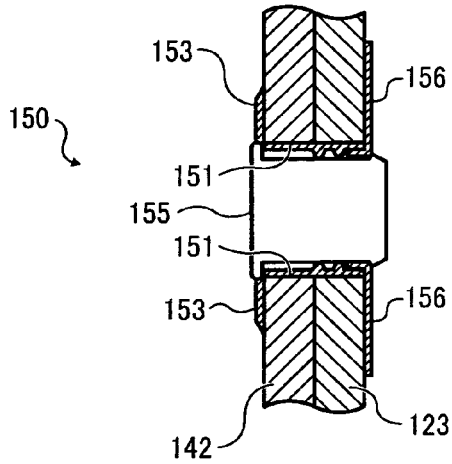

FIGS. 8A through 8C are cross-sectional views schematically illustrating the fastener 150 in use to fasten the sheet 140 to the enclosure box 120.

To install the fastener 150, first, the tubular body 151 is inserted into the aligned through-holes 143 and 127 of the sheet flap 142 and the enclosure wall 123 with the plug 155 remaining outside or partially inside the tubular body 151. The tubular body 151 is squeezed until the flange 153 comes into contact with the sheet flap 142 (FIG. 8A).

After inserting the tubular body 151, the plug 155 is inserted into the tubular body 151 from the flanged end toward the flange-less end (FIG. 8B).

The inserted plug 155 ultimately comes into contact with the hinged plates 156 to turn them approximately 90 degrees on their respective hinges, thereby engaging the tubular body 151 in the aligned through-holes 143 and 127. Thus, the fastener 150 connects together the sheet flap 142 and the box wall 123 by abutting the flange 153 against the sheet flap.142 at one end, and the plates 156 against the box wall 123 at the other end (FIG. 8C).

To release the connection between the sheet flap 142 and the box wall 123, the fastener 150 is removed by retracting the plug 155 away from the flange-less end of the tubular body 151, returning the hinged plates 156 to their original positions, and then drawing the tubular body 151 away from the through-holes 127 and 143.

Thus, the fastener 150 provides secure connection between the enclosure box 120 and the sheet 140 through operation from outside the enclosure box 120 without requiring special tools for installation and releasing.

Referring back to FIG. 2, the eight corner pads 160, four between the enclosure base 130 and the article 10 and four between the article 10 and the box 120, are formed of plastic foam, such as expanded polystyrene (EPS) or expanded polyethylene (EPE), and are shaped to conform to the shape of the article 10 so as to cushion and hold the article 10 at eight corners of the container 100.

Specifically, the lower four pads 160 prevent horizontal displacement of the article 10, and the upper four pads 160 prevent vertical displacement of the article 10. Preferably, the lower pads 160 each has a protrusion on the bottom side and the enclosure base 130 has corresponding recesses at the four corners, so as to anchor each pad 160 to the enclosure base 130 by engaging the corresponding protrusion and recess, which enables more reliable positioning of the pads 160 and the cushioned article 10 on the enclosure base 130.

Having described configurations of the respective elements of the packaging container 100, the following describes procedures for packaging the article 10 in the container 100 with particular reference to FIG. 2.

First, the enclosure base 130 is placed on the top deck of the pallet 110 with the side flaps 132 folded upward along the fold lines 134, the tabs 135 folded downward along the fold lines 136, and the end flaps 137 folded upward along the fold lines 138, so that the tabs 135 fit in the gap 115 against the top deck spacers 114.

After positioning the enclosure base 130, the four corner pads 160 are placed on the respective corners of the enclosure base 130, preferably each having a protrusion on the bottom to engage with a corresponding recess formed in the enclosure base 130. Then, the article 10 is placed on the lower pads 160, followed by providing the additional four pads 160 on the upper corners of the article 10.

With the article 10 thus positioned, the enclosure box 120 is placed on the pallet 110 from above, with the open bottom 121 allowing entry of the article 10 into the box 120 during placement. When set in place, the enclosure box 120 has the bottom edge (i.e., the lower edges of the side and end walls 123 and 124, or the perimeter of the open bottom 121) resting on the top deckboards 112 and the top deck spacers 114 around the perimeter of the enclosure base 130.

The top deckboards 112 and the spacers 114, having a substantially equal height, form a substantially even, planar surface maintaining continuous contact with the box edge, which prevents damage to the box 120 by distributing loads applied thereto, allowing for stacking of multiple containers, while preventing dust and other contaminants from entering the enclosure box 120.

After placing the enclosure box 120, the sheet 140 is inserted into the space 117 through the opening 116, followed by folding the flaps 142 upward along the fold lines 144 and bringing the center panel 141 into contact with the top deckboards 112. The sheet 140 thus wrapping the top deck of the pallet 110 is fastened to the enclosure box 120 by engaging the fasteners 150 in the through-holes 143 and 127 aligned with each other. As mentioned earlier, the enclosure base 130 inside the enclosure box 120 does not interfere with installation of the fasteners 150 owing to the openings 133 providing clearance between the fasteners 150 and the side flaps 132.

In the container 100 thus completed, the pallet 110 is securely connected to the enclosure box 120 by the sheet 140, and to the enclosure base 130 by the interlock between the tabs 135 and the top deck gap 115. Such secure connection effectively stabilizes the enclosed article 10 during handling of the container 100, since the article 10 is fixed to the walls of the enclosure box 120 and the enclosure base 130 by the cushioning pads 160.

The completed container 100 is ready for handling by a forklift with the pallet 110 accommodating the forklift tines in the deck space 117. With the enclosure base 130 and the sheet 140 sandwiching the top deck gap 115, the container 100 prevents the forklift tines from accidentally sticking into the gap 115 to damage the enclosed article 10 during handling with a forklift.

Further, when necessary, the container 100 allows access to the enclosed article 10 by removing the enclosure box 120 from the pallet 110 through the ready and tool-less operation of the fasteners 150 as mentioned above.

Thus, the packaging container 100 according to this patent specification enables secure connection between the enclosure box and pallet, which requires no modification of an existing pallet design, while providing good protection of the enclosure against breakage as well as ready and tool-less assembly and disassembly of the integrated container.

Figure 9:
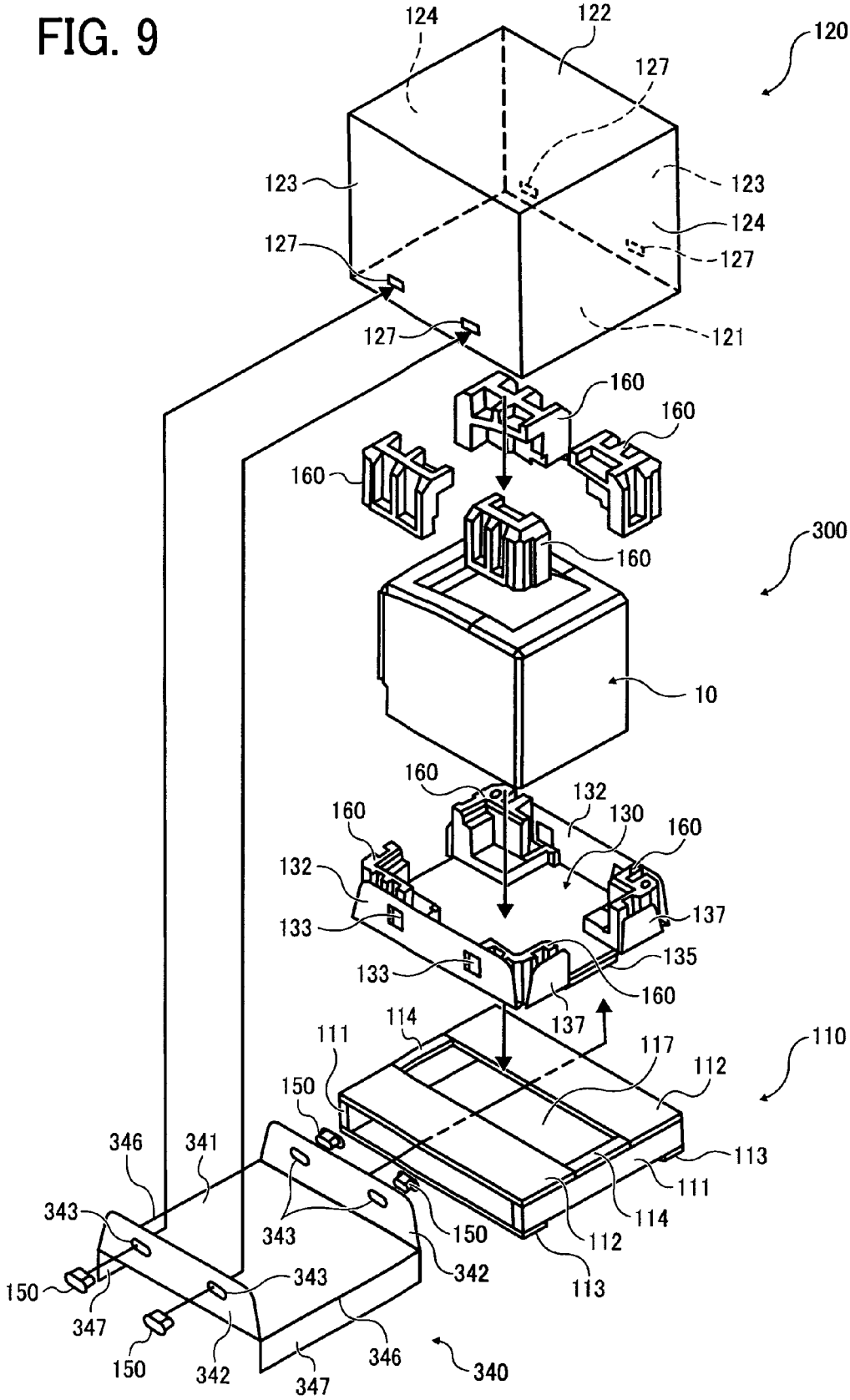
FIG. 9 is an exploded perspective view schematically illustrating a packaging container according to another embodiment of this patent specification.

FIG. 9 is an exploded perspective view schematically illustrating a packaging container 200 according to another embodiment of this patent specification.

As shown in FIG. 9, the general configuration of the container 200 is similar to that depicted primarily in FIG. 2, except that the container 200 uses a sheet 340 with additional flaps instead of the sheet 140 of FIG. 6.

Specifically, the sheet 340 includes a substantially rectangular center panel 341, a pair of side flaps 342, four through-holes 343 (two each in each of side flaps 342), and a pair of parallel fold lines, similar to those of the sheet 140. In addition, the sheet 340 includes a pair of flaps 347 extending from another pair of opposed parallel sides of the center panel 341, and a pair of fold lines 346 separating the center panel 341 from the flaps 347.

During assembly, the blank of the sheet 340 is folded downward along the fold lines 346, so as to lower the end flaps 347 before insertion into the deck space 117 and subsequent folding of the side flaps 342. The folded end flaps 347 each has a height slightly smaller than that of the space 117, and when inserted into the space 117, has a bottom edge resting on the bottom deckboards 113 to retain the center panel 341 immediately beneath the top deckboards 112, which facilitates subsequent fastening of the sheet 340 to the enclosure box 120.

Thus, the embodiment with the downward flap 347 enables readier installation of the sheet 340, leading to enhanced usability of the container according to this patent specification.

Figure 10:
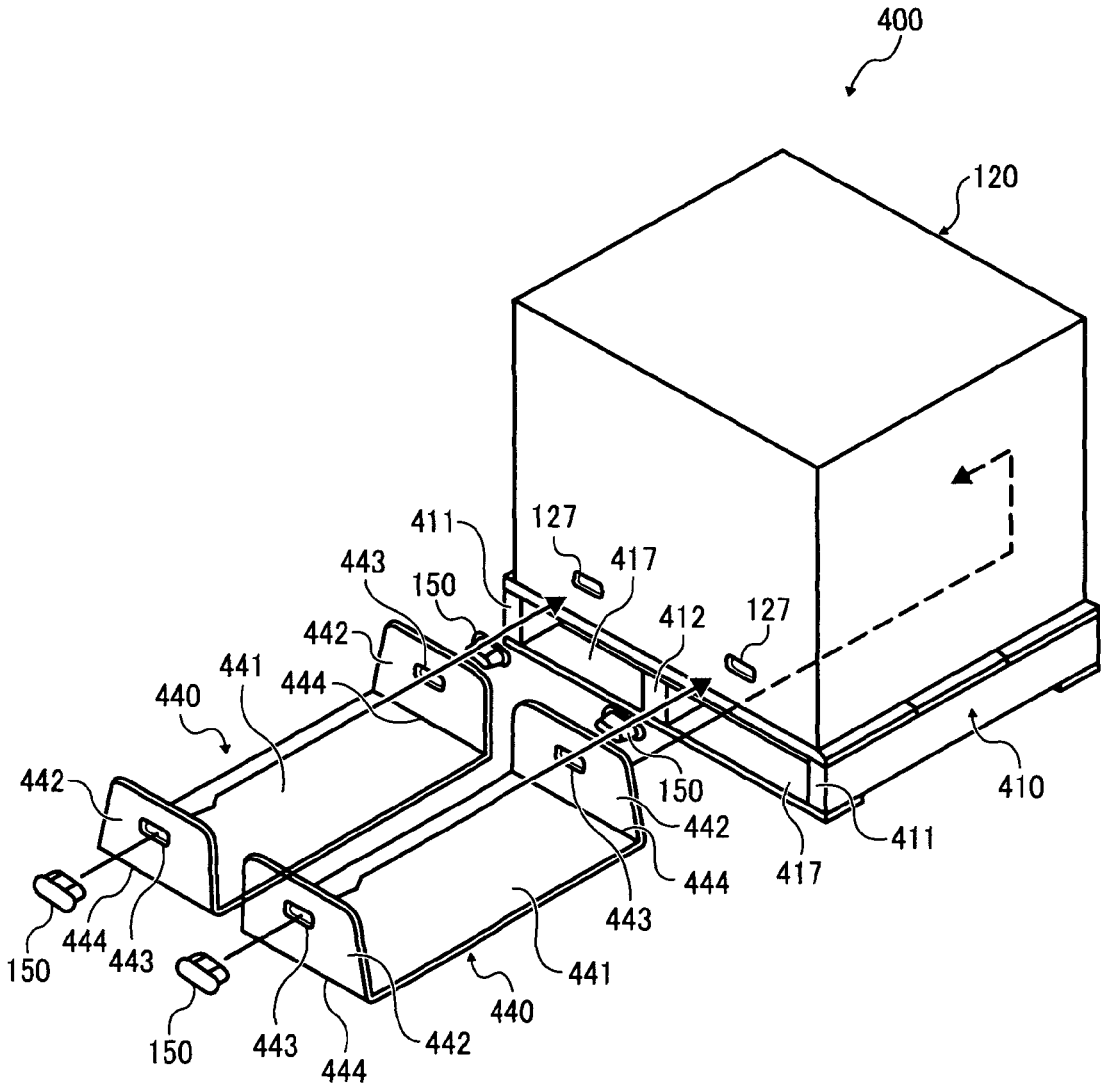
FIG. 10 is a partially exploded perspective view schematically illustrating a packaging container according to yet another embodiment of this patent specification.

FIG. 10 is a partially exploded perspective view schematically illustrating a packaging container 400 according to yet another embodiment of this patent specification.

As shown in FIG. 10, the general configuration of the container 400 is similar to that depicted primarily in FIG. 2, except that the container 400 uses a triple-stringer pallet 410 and a pair of twin sheets 440 instead of the pallet 110 and the sheet 140 of FIG. 2.

Specifically, the pallet 410 includes a middle stringer 412 in addition to a pair of end stringers 411, thus forming a pair of separate hollow spaces 417 on opposite sides of the middle stringer 412 between the top and bottom deckboards. The triple-stringer structure provides stiffness to the pallet 410, which is desirable particularly where the pallet has a substantial length over which to support a load of greater volume and weight.

In addition, the twin sheets 440 each includes a substantially rectangular, elongated center panel 441, a pair of side flaps 442 extending from opposite ends of the center panel 441, a pair of through-holes 443, one on each side flap 442, and a pair of parallel fold lines 444 separating the center panel 441 from the side flaps 443.

During assembly, each twin sheet 440 is inserted into the deck space 417, and is folded upward along the fold lines 444, so as to raise the side flaps 442 beyond the through-holes 127 of the enclosure box 120 with the through-holes 443 aligned with the through-holes 127 of the enclosure wall 123 for fastening with the fasteners 150.

Thus, the embodiment with the triple-stringer pallet 410 and the twin sheets 440 enables application of the container to packaging of heavy or bulky articles. Optionally, each twin sheet 440 may include additional downward flaps similar to those described in FIG. 9, which facilitates installation of the sheet 440 into the deck space 417.

Figure 11:
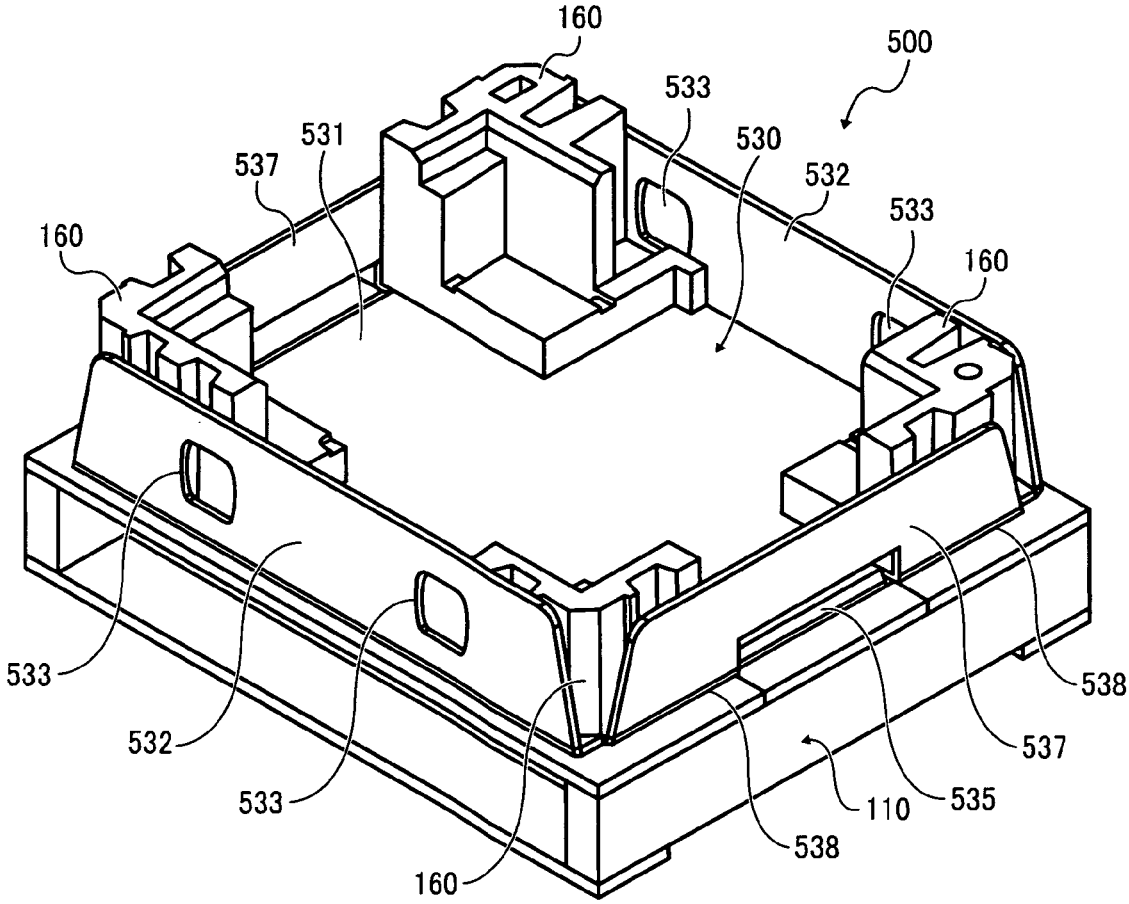
FIG. 11 is a partial perspective view schematically illustrating a packaging container according to still another embodiment of this patent specification.

FIG. 11 is a partial perspective view schematically illustrating a packaging container 500 according to still another embodiment of this patent specification.

As shown in FIG. 11, the general configuration of the container 500 is similar to that depicted in FIGS. 2, 9, or 10, except that the container 500 has a four-flap enclosure base 530 instead of the enclosure base 130 of FIG. 5.

Specifically, the enclosure base 530 includes a substantially rectangular center panel 531, a pair of side flaps 532, and four through-holes 533, similar to those depicted in FIG. 5. In addition, the enclosure base 530 includes a pair of integral end flaps 537 extending outward from the center panel 531, a pair of tabs 535 formed by cutting out a portion of the end flap 537, and a pair of parallel, discontinuous fold lines 538 on sides of the tabs 535 separating the center panel 531 from the end flaps 537.

The flat blank of the base 530 is folded upward along the fold lines 538 to raise the end flaps 537 above the center panel 531. The enclosure base 530 with the integral end flap 537 requires only a single fold to form each end wall to support the lower pads 160, whereas the enclosure base 130 with the separate end flaps requires two folds for each end wall. Thus, the embodiment of FIG. 11 saves time in installing the enclosure base 530, while the embodiment of FIG. 5 makes it effortless to form each end wall of the enclosure base 130 for ready assembly of the packaging container.

Numerous additional modifications and variations are possible in light of the above teachings. For example, pallets used in the packaging container according to this patent specification may be made of synthetic resin, metal, or any suitable material and may have four open sides to allow entry of forklift tines from four directions, although the embodiments described herein use a two-way pallet of wood or plywood.

Further, although the enclosure box, the enclosure base, and the sheet described above are formed of corrugated cardboard, alternatively these components may be formed of corrugated plastic or any other suitable material, and may be suitably sized and shaped depending on the intended application.

Furthermore, fastening the sheet to the enclosure box may be performed by using a fastener of a mechanism and a material other than the plastic flanged-tube fastener as described herein, as long as it can connect the sheet and box walls by being inserted into aligned openings from outside the enclosure box.

It is therefore to be understood that, within the scope of the appended claims, the disclosure of this patent specification may be practiced otherwise than as specifically described herein.

What is claimed is:

1. A packaging container used to package an article, the container comprising:

a pallet substantially rectangular in plan to carry the article thereon;

the pallet including:

a load carrying surface to carry the packaged article thereon; and a hollow space below the load-carrying surface having opposite side openings to allow entry of forklift tines during handling of the container;

an enclosure box resting on the load carrying surface to enclose the article therewithin, the enclosure box including:

a top wall to cover a top of the article;

first and second pairs of opposite side walls extending downward from the top wall to cover sides of the article;

an open bottom defined by edges of the side walls in contact with the load carrying surface to pass the article therethrough during assembly; and a first set of through-holes defined in the first pair of side walls adjacent to the open bottom;

an enclosure base lying between the article and the load carrying surface to hold the article within the enclosure box;

a sheet extending across at least a portion of a lower side of the load carrying surface and the first pair of opposite side walls to secure the pallet to the enclosure box when fastened to the enclosure box, the sheet including:

a flat center panel that underlies the portion of the lower side of the load carrying surface;

a pair of side flaps extending from opposite sides of the center panel upward along the first pair of opposite side walls beyond the first set of through-holes; and a second set of through-holes defined in the pair of side flaps to align with the first set of through-holes; and a set of fasteners passed through the first and second sets of through-holes to fasten the sheet to the enclosure box from outside the enclosure box.

2. The packaging container according to claim 1, wherein the pallet includes multiple top deckboards extending in a first direction with a gap therebetween to form the load-carrying surface to carry the packaged article thereon, the first direction being perpendicular to a second direction in which the forklift tines enter the hollow space through the side openings of the pallet;

the sheet inserted into the hollow space during assembly to locate the center panel beneath and across the load-carrying surface to cover the gap between the top deckboards.

3. The packaging container according to claim 1, wherein the pallet and the enclosure base at least partially interlock with each other to restrict movement of the enclosure base on the underlying pallet.

4. The packaging container according to claim 1, wherein the sheet further includes a flap extending downward from the center panel to retain the sheet in place upon insertion into the hollow space.

5. The packaging container according to claim 1, wherein the set of fasteners are operated without using tools.

6. A method for packaging an article in a container, the method comprising:

providing a pallet substantially rectangular in plan, the pallet including:

a load carrying surface to carry the packaged article thereon; and a hollow space below the load-carrying surface having opposite side openings to allow entry of forklift tines during handling of the container;

providing an enclosure base on the load carrying surface;

placing the article on the enclosure base;

placing an enclosure box on the load carrying surface to enclose the article and the enclosure base therewithin, the enclosure box including:

a top wall to cover a top of the article;

first and second pairs of opposite side walls extending downward from the top wall to cover sides of the article;

an open bottom defined by edges of the side walls in contact with the load carrying surface to pass the article therethrough; and a first set of through-holes defined in the first pair of side walls adjacent to the open bottom;

placing a sheet across at least a portion of a lower side of the load carrying surface and the first pair of opposite side walls, the sheet including:

a flat center panel that underlies the portion of the lower side of the load carrying surface;

a pair of side flaps extending from opposite sides of the center panel upward along the first pair of opposite side walls beyond the first set of through-holes; and a second set of through-holes defined in the pair of side flaps to align with the first set of through-holes; and fastening the sheet to the enclosure box from outside the enclosure box to secure the pallet to the enclosure box by passing a set of fasteners through the first and second sets of through-holes.

7. The packaging container according to claim 1, wherein the pallet comprises a triple-stringer pallet with a middle stringer and a pair of end stringers extending parallel to each other to define a pair of separate hollow spaces below the load-carrying surface having opposite side openings to allow entry of a forklift tine, and the sheet comprises a pair of twin sheets each inserted into one of the separate hollow spaces to extend across at least the portion of the lower side of the load carrying surface and the first pair of opposite side walls to secure the pallet to the enclosure box when fastened to the enclosure box.

8. The packaging container according to claim 2, further comprising a spacer disposed within the gap defined between the top deckboards, the spacer and the top deckboards having a substantially equal thickness to together form a substantially planar load carrying surface.

9. The packaging container according to claim 4, wherein the flap has a height slightly smaller than a height of the hollow space.

10. The method according to claim 6, wherein the pallet includes multiple top deckboards extending in a first direction with a gap therebetween to form the load-carrying surface to carry the packaged article thereon, the first direction being perpendicular to a second direction in which the forklift tines enter the hollow space through the side openings of the pallet, and the sheet inserted into the hollow space during assembly to locate the center panel beneath and across the load-carrying surface to cover the gap between the top deckboards.

11. A packaging container used to package an article, the container comprising:

a pallet substantially rectangular in plan to carry the article thereon, the pallet including:

a plurality of top deckboards to carry and support the packaged article thereon; and a hollow space below the plurality of top deckboards to allow entry of forklift tines during handling of the container;

an enclosure box resting on the plurality of top deckboards to enclose the article therewithin, the enclosure box including:

a top wall to cover a top of the article;

first and second pairs of opposite side walls extending downward from the top wall to cover sides of the article;

an open bottom defined by edges of the side walls in contact with the plurality of top deckboards to pass the article therethrough during assembly; and a first set of through-holes defined in the first pair of side walls adjacent to the open bottom;

an enclosure base lying between the article and the plurality of top deckboards to hold the article within the enclosure box;

a sheet extending across at least a portion of a lower side of the plurality of top deckboards and the first pair of opposite side walls to secure the pallet to the enclosure box when fastened to the enclosure box, the sheet including:

a flat center panel that underlies the portion of the lower side of the plurality of top deckboards;

a pair of side flaps extending from opposite sides of the center panel upward along the first pair of opposite side walls beyond the first set of through-holes; and a second set of through-holes defined in the pair of side flaps to align with the first set of through-holes; and a set of fasteners passed through the first and second sets of through-holes to fasten the sheet to the enclosure box from outside the enclosure box.

12. The packaging container according to claim 11, wherein the pallet includes:

the plurality of top deckboards extending in a first direction with a gap therebetween to form a load-carrying surface to carry the packaged article thereon, the first direction being perpendicular to a second direction in which the forklift tines enter the hollow space through the side openings of the pallet; and the sheet inserted into the hollow space during assembly to locate the center panel beneath and across the load-carrying surface to cover the gap between the plurality of top deckboards.

13. The packaging container according to claim 11, wherein the pallet and the enclosure base at least partially interlock with each other to restrict movement of the enclosure base on the underlying pallet.

14. The packaging container according to claim 11, wherein the sheet further includes a flap extending downward from the center panel to retain the sheet in place upon insertion into the hollow space.

15. The packaging container according to claim 11, wherein the set of fasteners are operated without using tools.

* * * * *